US006247960B1

(12) United States Patent
Daoud

(10) Patent No.: US 6,247,960 B1
(45) Date of Patent: Jun. 19, 2001

(54) TOP ACCESS SLIDEABLE INSULATION DISPLACEMENT CONNECTOR

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/495,997

(22) Filed: Feb. 1, 2000

(51) Int. Cl.[7] ..... H01R 4/24; H01R 4/26
(52) U.S. Cl. ..... 439/417; 439/389
(58) Field of Search ..... 439/417, 395, 439/409

(56) References Cited

U.S. PATENT DOCUMENTS 5,620,332 * 4/1997 Gerke et al. ..... 439/417
5,664,962 * 9/1997 Noda ..... 439/394
5,860,829 * 1/1999 Hower et al. ..... 439/417
6,139,353 * 10/2000 Muz ..... 439/417

FOREIGN PATENT DOCUMENTS

019835459A1 * 2/2000 (DE) .
008121457 * 5/1983 (FR) .

* cited by examiner

*Primary Examiner*—Khiem Nguyen
*Assistant Examiner*—Michael C. Zarroli
(74) *Attorney, Agent, or Firm*—Howard C. Miskin; Gloria Tsui-Yip

(57) ABSTRACT

The insulation displacement connector provides top access to facilitate insertion of conductors for interconnection with a sliding action. The top access slideable connector comprises a channel-shape conductive terminal having at least one key-hole opening and tails for wire wrapping, a channel-shape housing comprises an upper surface and an interior panel, both the surface and the panel each having at least one corresponding opening in axial alignment with the other and correspond to the key-hole and a base plate with a plurality of openings through some of which the terminal tails extend from. The housing receives the terminal and is slideable mounted onto the base plate with latching members. When the corresponding surface, panel and the larger part of the key-hole openings are in alignment, a conductor is inserted through the three corresponding openings. Upon sliding the housing along the base plate, the surface and panel openings force the conductor to move into the narrower part of key-hole opening for electrical connection with the terminal.

12 Claims, 11 Drawing Sheets

TOP ACCESS SLIDEABLE INSULATION DISPLACEMENT CONNECTOR

This invention relates to insulation displacement connectors and, more particularly, to a top access insulation displacement connector utilizing a sliding element to force and positively hold a conductor in electrical contact with another conductor.

BACKGROUND OF THE INVENTION

A wide variety of connectors for making electrical connections are presently used and are mounted on blocks in a building entrance protector, i.e. junction box. A common type of connector is an Insulation Displacement Connector (IDC), which is widely used in different types of applications for interconnecting wires; particularly, in the telecommunications industry. An IDC terminal eliminates the need to strip the insulation from a wire prior to making the connection. Since multiple connectors are often positioned in groups on blocks in a small cramped space within a junction box, it is critical and essential to place a selected conductor in the correct connector opening for making contact with a corresponding conductor. In view of the adjacency of multiple openings on a block of connectors and the small space within which to work, this is often difficult, inefficient and time consuming to make a series of good electrical connections between the exposed ends of the conductors and the connector to ensure that each engages the contact element for connection to its corresponding preselected conductors. It is important to accommodate a greater number of conductors in the connectors without reducing reliability and electrical connecting efficiency.

Conventional connectors have side wire-connecting openings for receiving the conductor or wire. A conductor is placed into the conductor-receiving opening for engagement with a terminal in the connector for interconnection. As a block of connectors are typically mounted on a junction box on a wall, a technician working with a side-opening connector does not have a top view of the openings. Thus, connectors with side openings are more difficult to use or to identify the corresponding interconnection, which slows the process, creating higher labor costs. Some of the prior art connectors utilize angled side openings, which simplify insertion of conductors but do not remedy the problem.

Therefore, there is a need for an insulation displacement connector having top access openings for receiving conductors to facilitate identification to ensure proper interconnection.

SUMMARY OF THE INVENTION

This invention provides a connector terminal that quickly and easily receives conductors to make particular electrical interconnection between selected cooperating wires.

The invention provides a top access insulation displacement connector (IDC) that is securely retained within the housing and is operative by inserting a conductor into a series of aligned openings. This connector terminal has top access and provides strain relief to the conductor while making a positive electrical connection with the selected conductor by sliding housing.

A top access connector is provided with a strain relief position, such that the conductor can resist inadvertent pulling and compressive force exerted on the connector without conductor displacement. The top access connector has three elements, a generally channel-shaped conductive terminal with tails for interconnecting two conductors, a housing which has an interior space and a cantilevered interior panel which underlies the terminal and a base or back plate having a plurality of openings through some of which the tails of the terminal extend from. The housing has at least one pair of axially aligned openings, one on the upper surface and the other on the interior panel, which in turn are aligned with the larger part of a generally keyhole-shaped corresponding opening in the terminal. The housing receives the terminal in the interior space and is then slideable mounted on the back plate through some of its openings. At least one conductor is positioned in the three aligned openings. When the housing is slid slightly along the back panel, it forces the conductor to move in the terminal opening toward the narrower portion of the key-hole, which cuts the insulation to effect an insulation displacement of the conductor to make a conductive connection with the terminal. The terminal in turn is wire wrapped to another conductor to make an electrical interconnection between the inserted wire and the conductor. The inserted conductor is positively engaged in position so that accidental withdrawal of the conductor is prevented and it remains anchored and in positive electrical connection with the wire wrapped terminals.

DETAILED DESCRIPTION OF A PREFERRED EMBODIMENT

Figure 1:
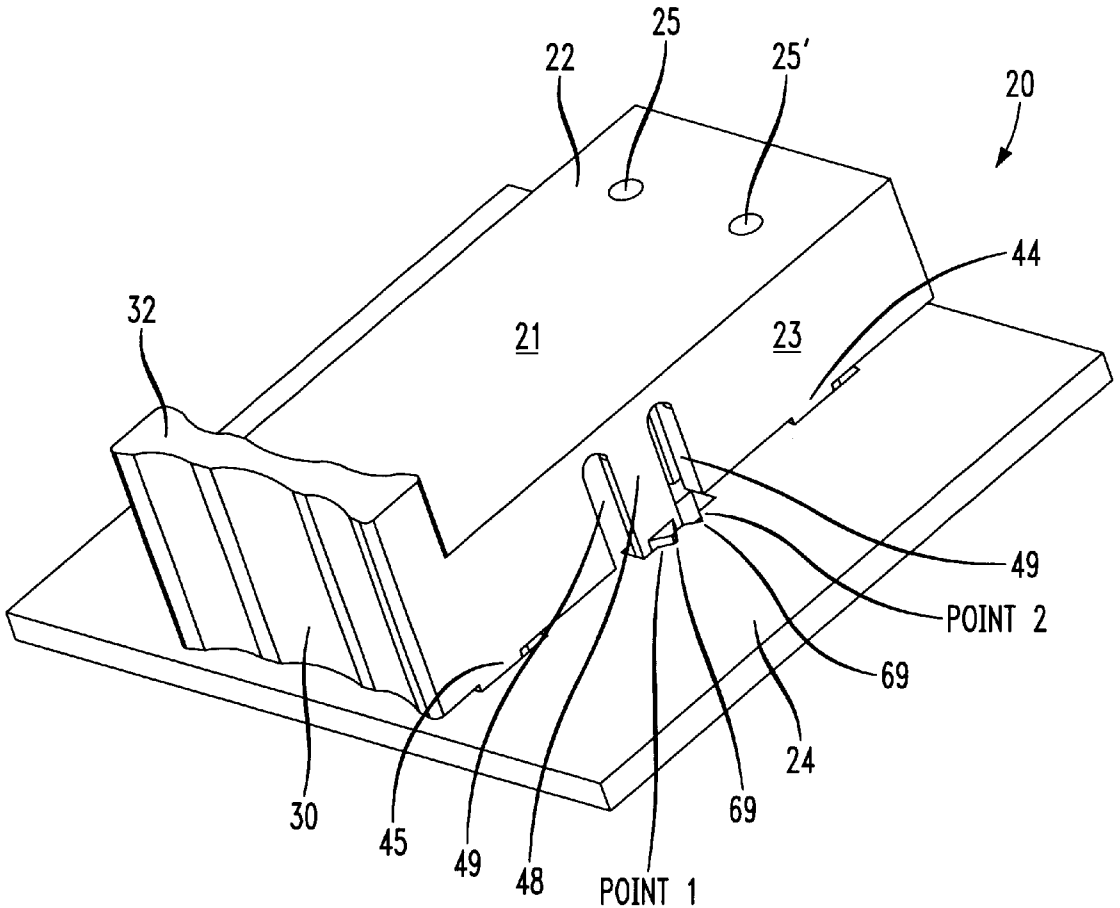
FIG. 1 is a top, front perspective view of a connector in accordance with the present invention.

With reference to the drawings, wherein the same reference number indicates the same element throughout, FIG. 1 illustrates a top access connector 20, made in accordance with the present invention. Connector 20 has a housing 22, back panel 24, and a terminal 26 (shown in FIGS. 6 and 7).

Figure 2:
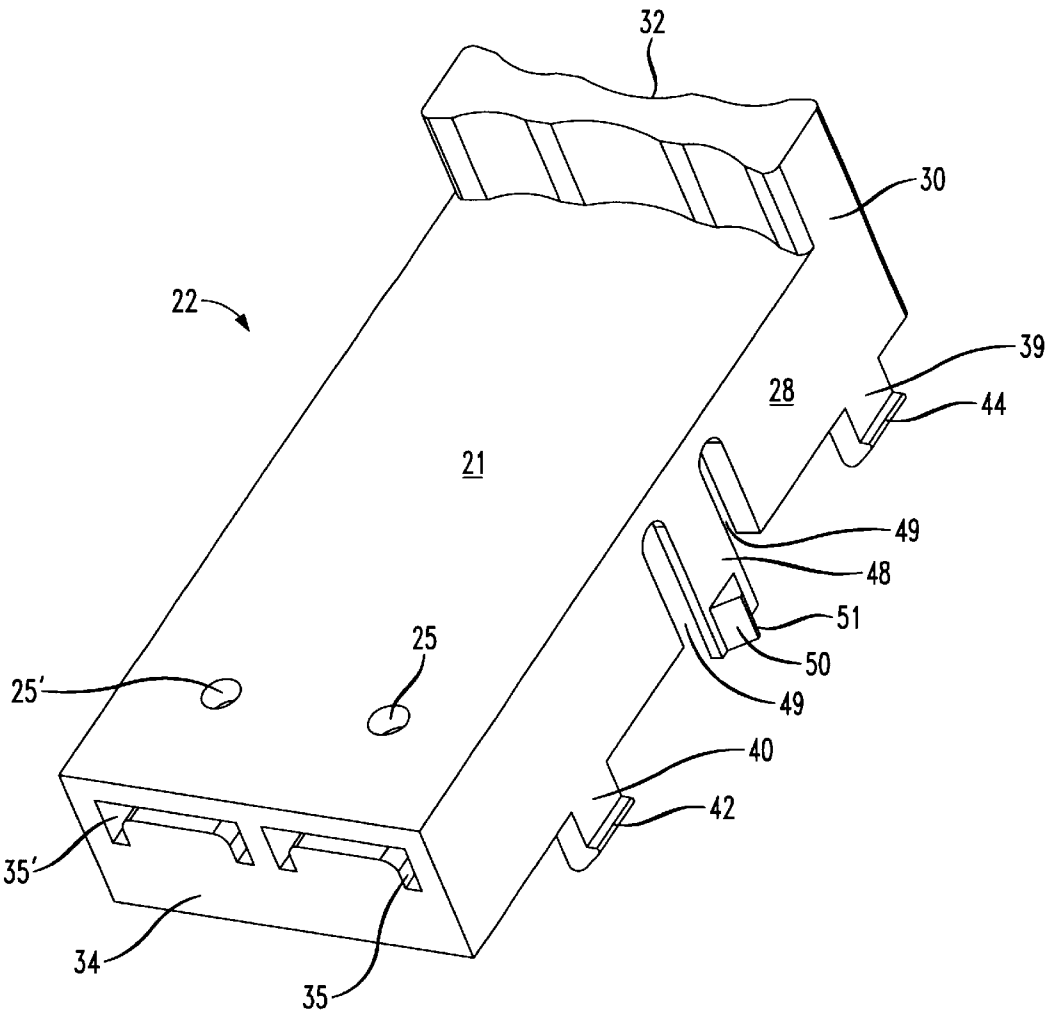
FIG. 2 is a top, rear perspective view of the housing.
Figure 3:
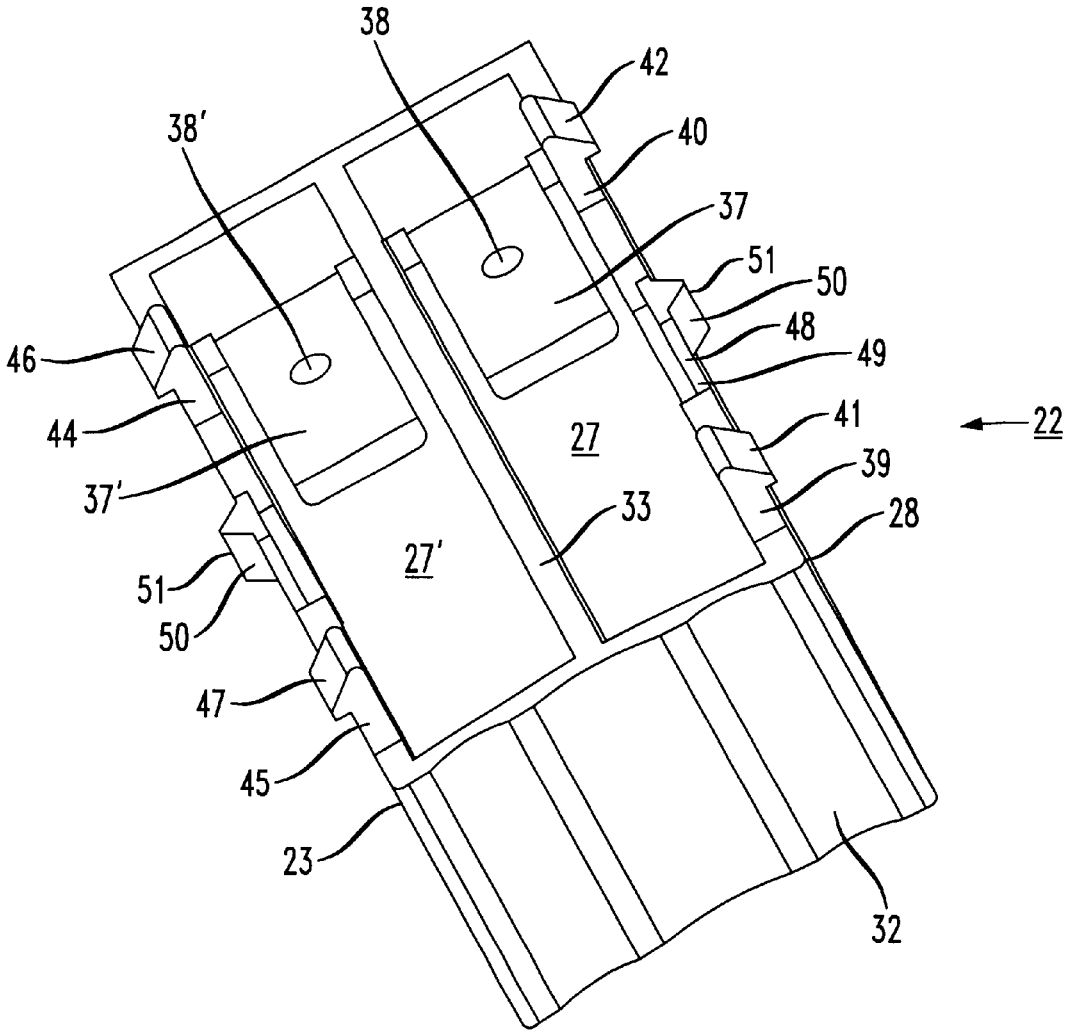
FIG. 3 is a bottom perspective view of the housing.
Figure 4:
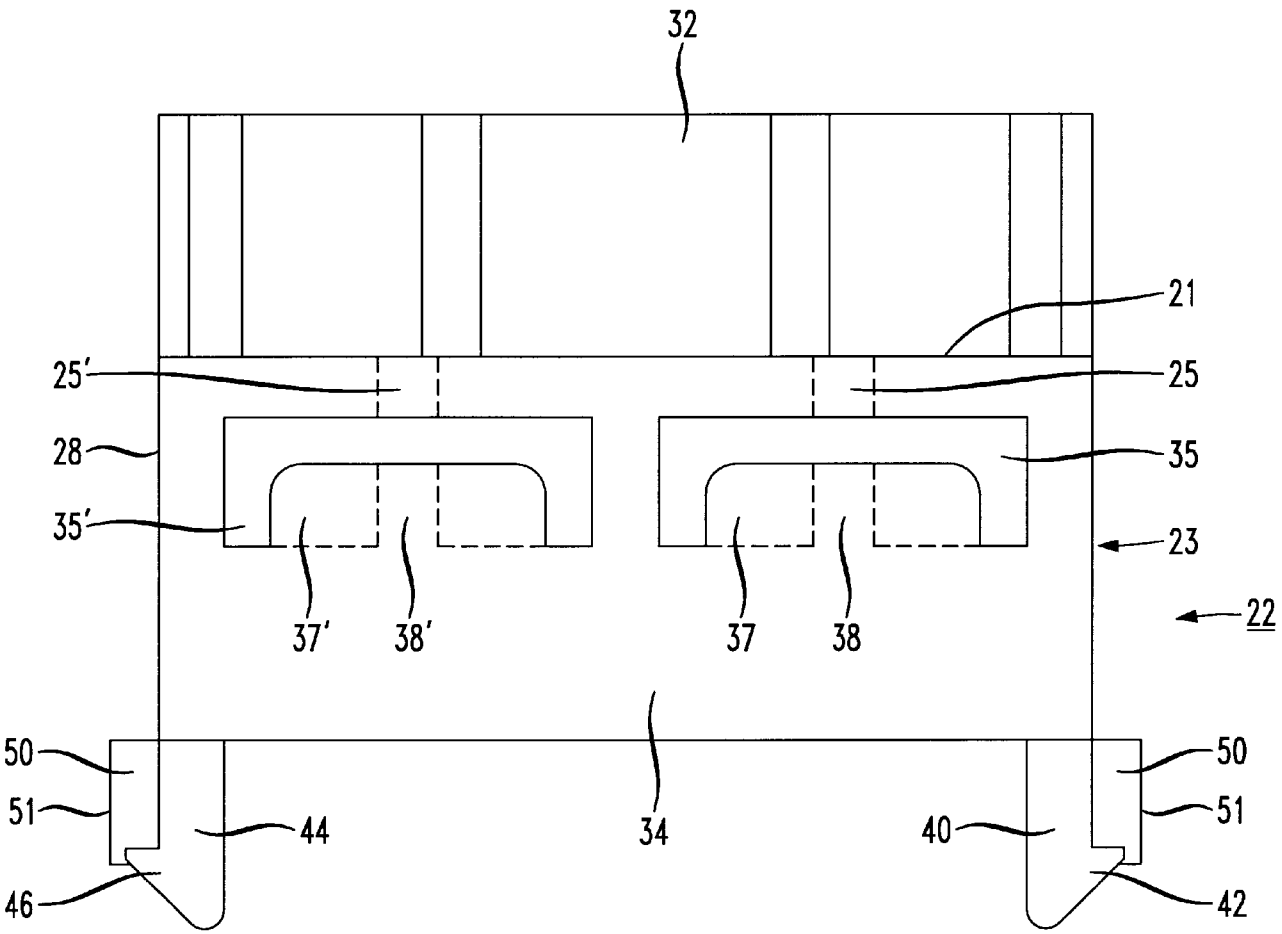
FIG. 4 is a rear view of the housing.

As shown in FIGS. 2 to 4, housing 22 is shown as a generally channel-shaped unit with a top 21 and side walls 23 and 28 respectively extending therefrom. One end of housing 22 is a wall 30, having a portion 32 extending above the top 21. Extension 32 operates as a handle, as will be discussed below. The other end of housing 22 is closed by a wall 34, having a pair of channel-shaped openings 35 and 35'. On the top 21 of housing 22 is a pair of openings 25 and 25'. As seen best in FIG. 3, the underside or interior of housing 22 has a longitudinally extending wall 33 dividing the interior space into two parts, 27 and 27' to accommodate two terminals 26 and 26'. Extending from wall 34 into spaces 27 and 27' are a pair of spaced apart, cantilevered panels or surfaces 37 and 37' each having an opening 38 and 38', in axial alignment and corresponding to openings 25 and 25'. Extending downwardly from side 28 are a pair of latching legs 39 and 40, each having a lip 41 and 42, respectively, extending outwardly from the bottom edge of their respective legs. Similarly, extending downwardly from side 23 of housing 22 are a pair of latching legs 44 and 45, each having a lip 46 and 47 respectively extending outwardly at its bottom. Spaced generally centrally along wall 28 is a detent finger 48 with cutouts 49 on each side to provide for flexibility of finger 48. Extending outwardly along the bottom end of finger 48 is an extension 50, which is shown tapered at each side forming an edge 51. A similar finger 48 extends generally centrally along side wall 23 and bears the same identification numbers for the same elements.

Figure 6:
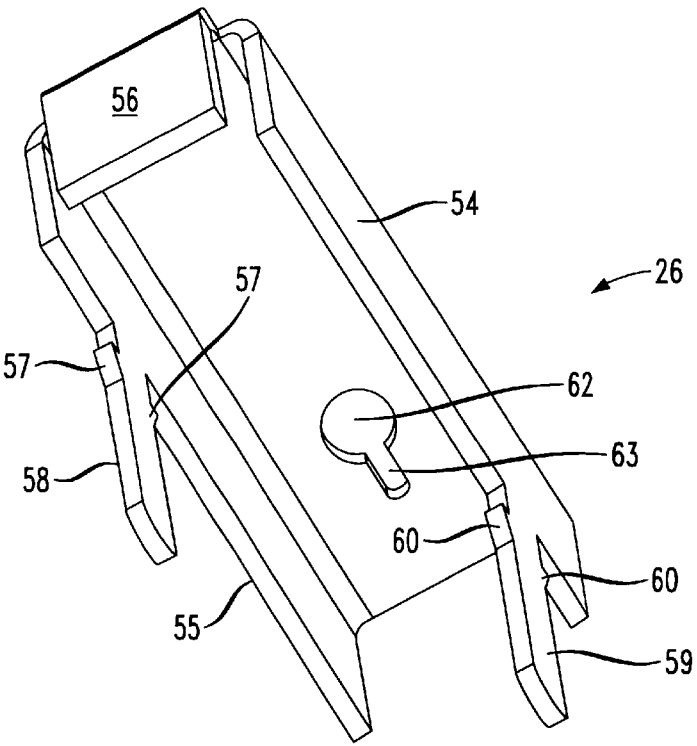
FIG. 6 is a bottom, rear perspective view of the terminal.
Figure 5:
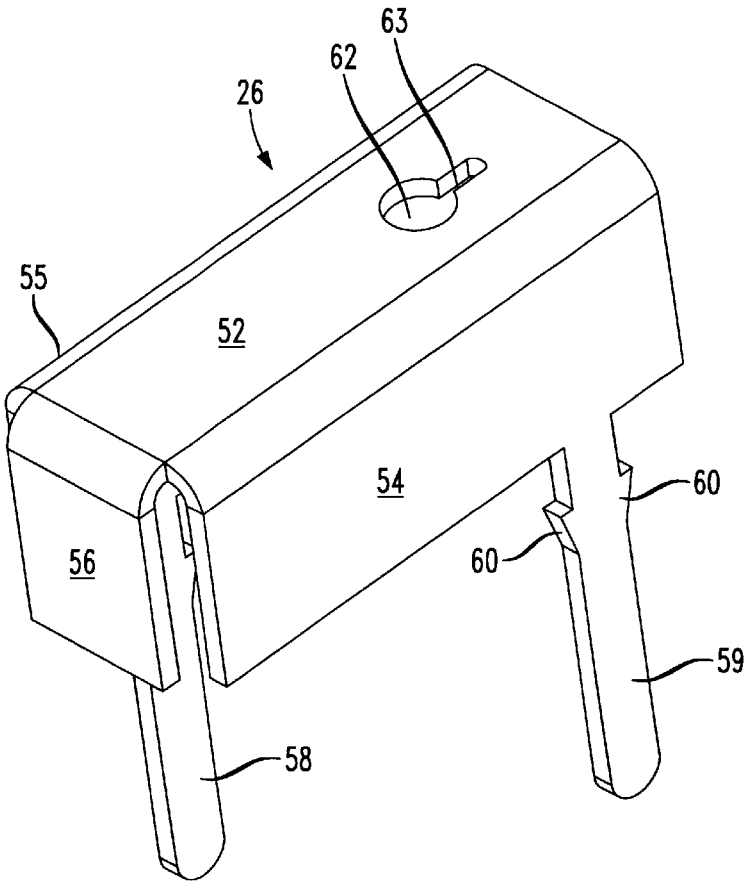
FIG. 5 is a top, front perspective view of the terminal.

As best seen in FIGS. 5 and 6, terminal 26 is shown in generally a channel shape unit with a base 52, two extending sides 54 and 55, a rear end 56 and an open end. As best seen in FIG. 6, extending downwardly from opposite ends of each of the sides 54 and 55 are tails 58 and 59, respectively. Tail 58 has a pair of latching surfaces 57 extending on opposite sides spaced a predetermined distance from the bottom of side 55. Similarly, terminal 59 has a pair of latching surfaces 60 extending outwardly from opposite sides, located the same predetermined distance below the end of side 54. The pre-determined distance from latching surfaces 57 and 60 from the bottom of sides 55 and 54, respectively, is the general thickness of the back panel 24. Positioned in base 52 of terminal 26 is a generally keyhole-shaped opening 62, having a larger opening interconnected with a smaller, longitudinally extending narrower opening 63. Preferably, the inner surfaces of opening 63 are tapered to form a cutting surface for penetrating the insulation of a conductor. While one form of opening is shown, other shapes may be used such as a tapered opening with the narrower opening facing the open end.

Figure 7:
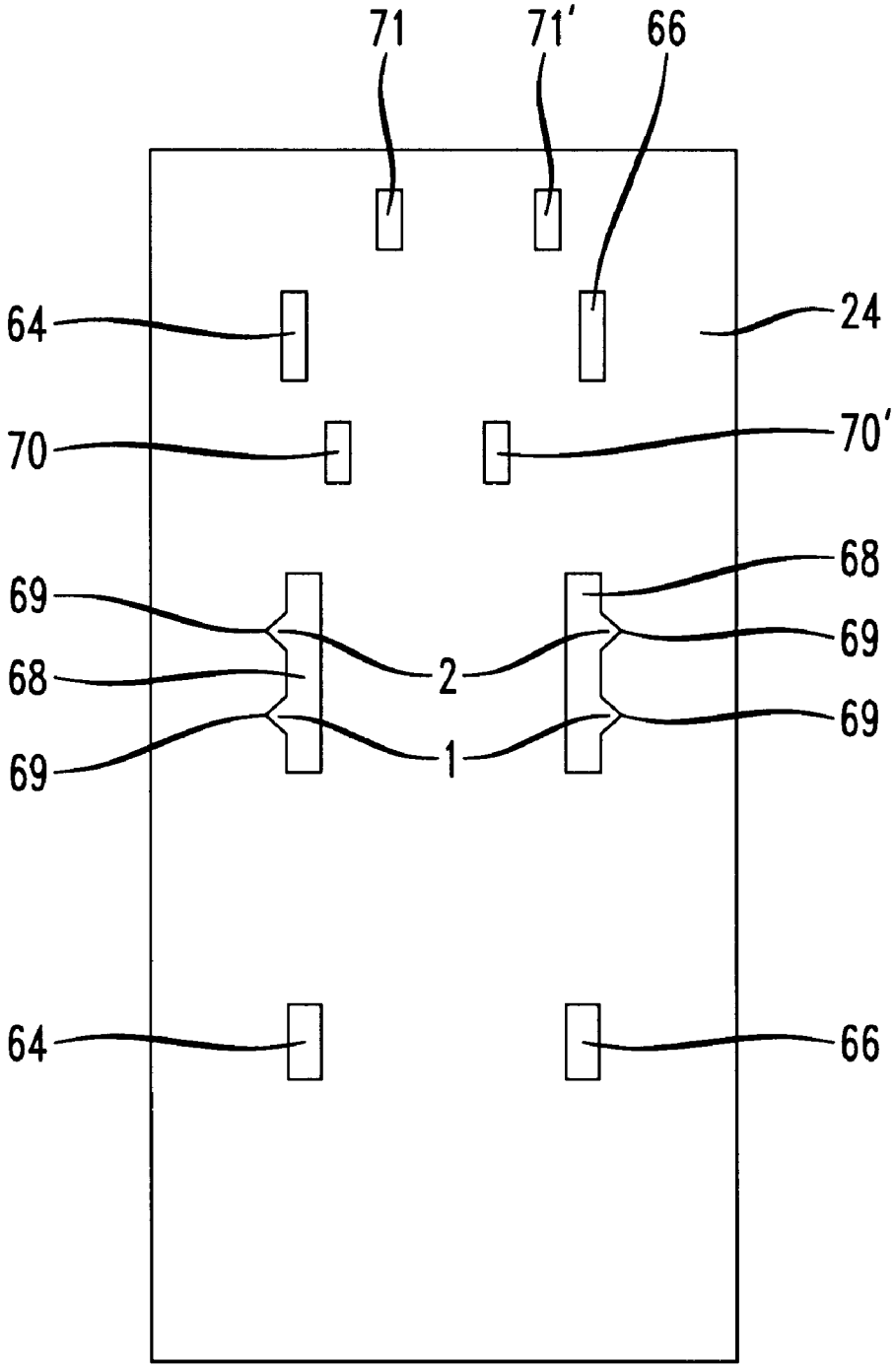
FIG. 7 is a top plan view of the back panel.

FIG. 7 shows back panel 24 as generally a flat surface of any desired length and width, but at least slightly larger than the area of housing 22. Back panel 24 has a pair of longitudinally aligned openings 64 of sufficient length and width to receive latching legs 39 and 40. The upper surface of lips 41 and 42 extend below the underside of side wall 28 a distance slightly greater than the depth of back panel 24. Similarly on the opposite side of back panel 24 are longitudinally aligned openings 66 to receive latching legs 44 and 45. Similarly, the width and length of openings 66 are sufficient to receive lips 46 and 47 of legs 44 and 45 and the upper surface of lips 46 and 47 extend below the underside of side wall 23 at the same distance as those of lips 41 and 42. Detent fingers 48 with its tapered extension 50 are received respectively on opposite sides in cooperative openings 68 on the back panel 24. Each opening 68 has outwardly facing, spaced apart notches 69. The shape of each of these notches 69 mates with the corresponding tapered edge 51 of extension 50 on the ends of each detent finger 48.

Each of openings 64 and 66 are longer in length than the length of mating latching legs 39, 40, 44 and 45, respectively, of an amount of at least equal to the predetermined distance between the notches 69 of openings 68. At one end of back panel 24 are openings 70 and 71 for matingly receiving tails 58 and 59, respectively, extending from terminal 26. Similarly, openings 70' and 71' at the same end matingly receive tails 58' and 59' of a second terminal 26 (not shown).

Figure 8:
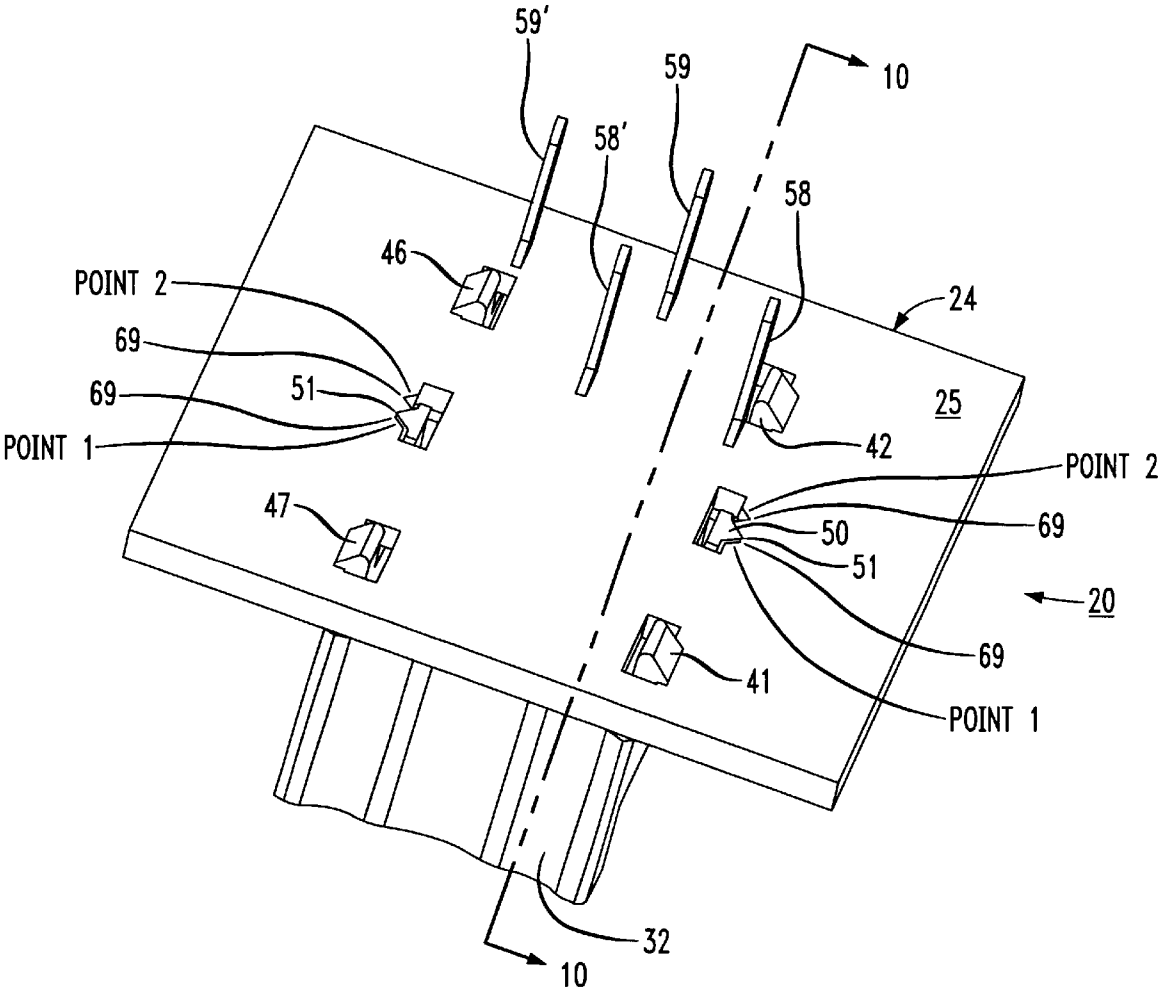
FIG. 8 is a bottom, front perspective view of the connector in conductor receiving position.
Figure 9:
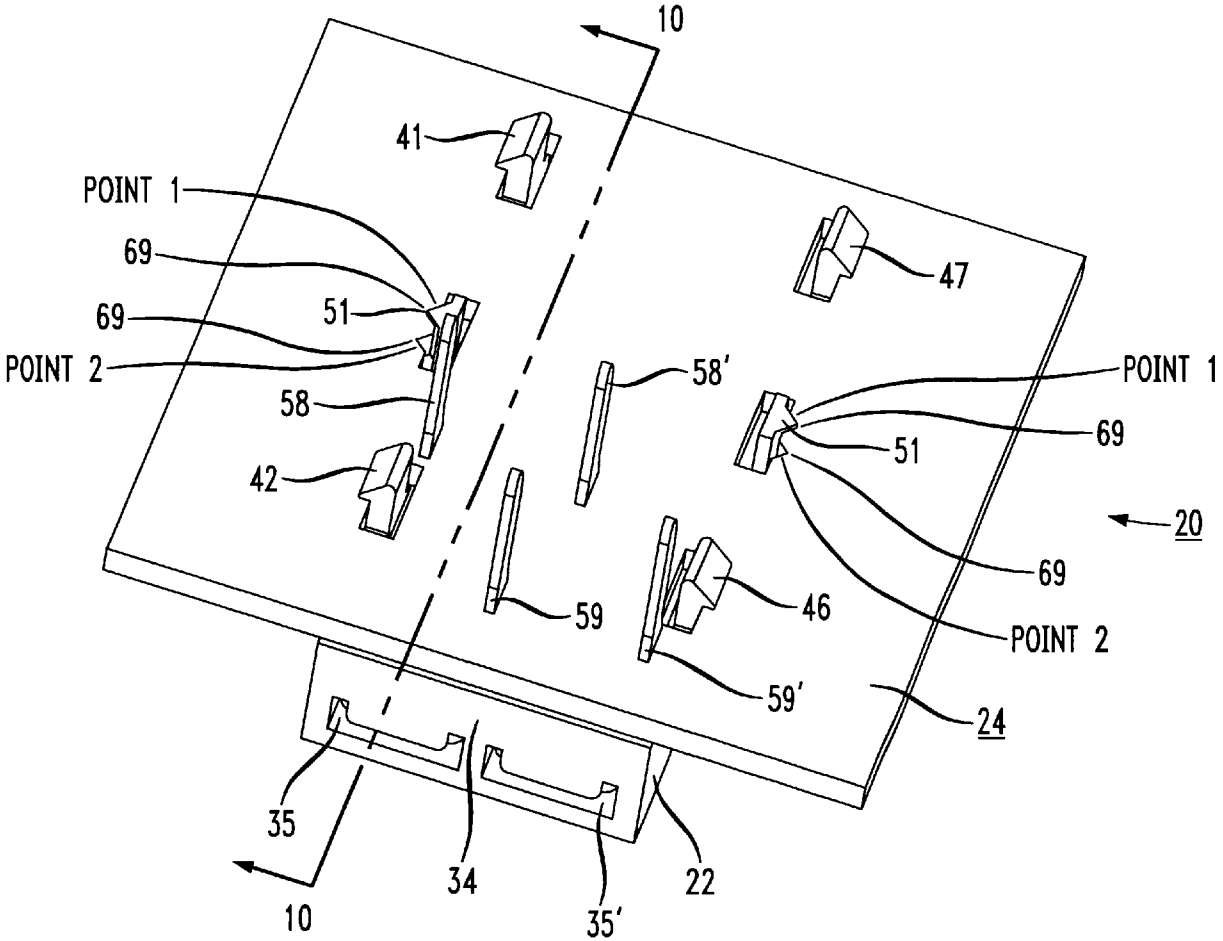
FIG. 9 is a bottom, rear perspective view of FIG. 8.
Figure 10:
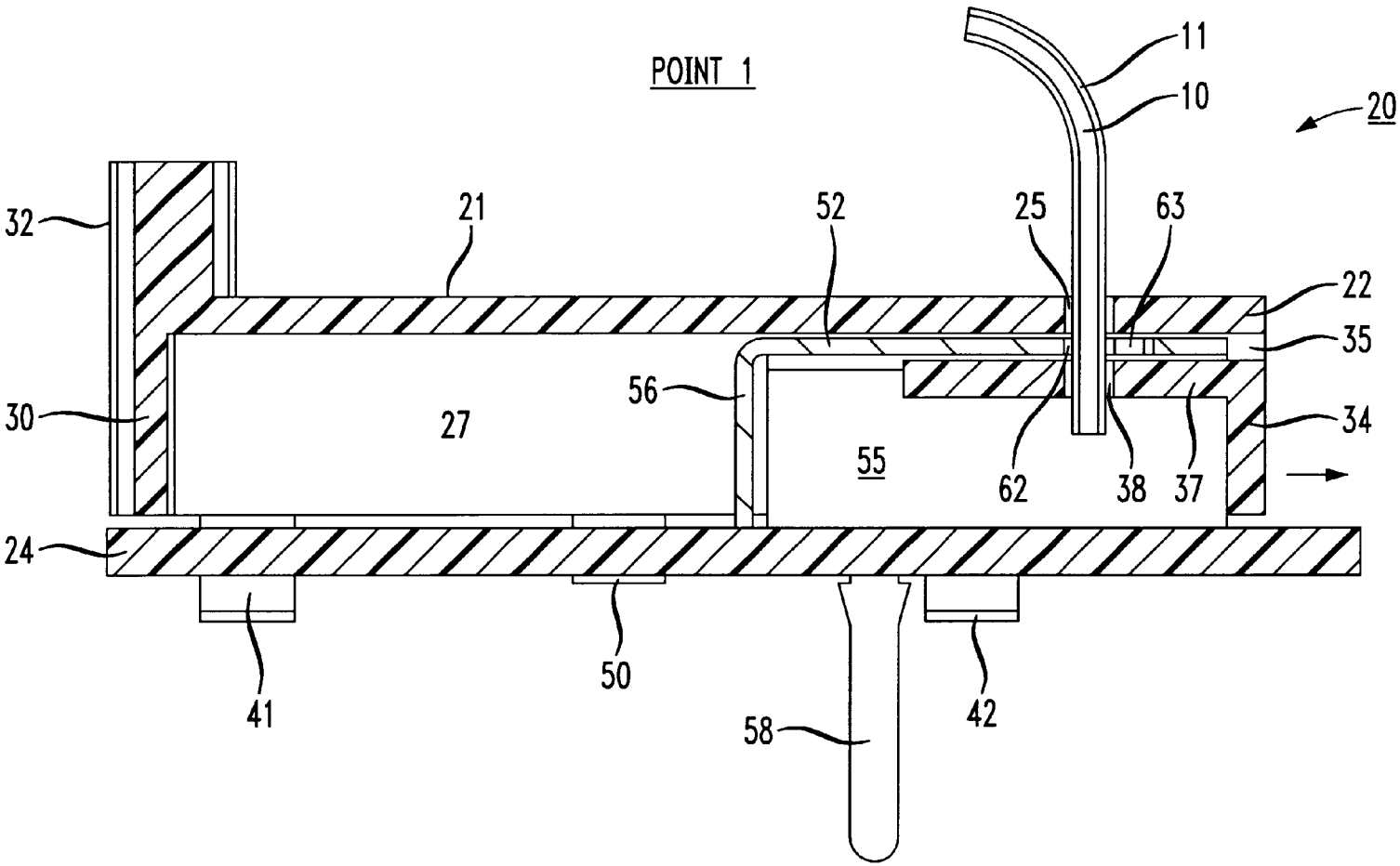
FIG. 10 is a cross-sectional view taken along 10—10 of FIGS. 8 or 9, illustrating an insertion of the conductor in a non-connected position (point 1).

In assembly, terminal 26 is mounted on back panel 24 and in space 27 of housing 22, so that the upper surface of base 52 of terminal 26 is slid along the bottom surface of top 21 of housing 22, with the open end of terminal 26 fitted over the cantilevered panel 37 of housing 22, as seen best in FIG. 10. Housing 22 with terminal 26 is snapped into back panel 24 with latching legs 39, 40, 44 and 45 going through corresponding back panel openings 64 and 66, respectively, with detent fingers 48 snapping into the corresponding back panel openings 68, and terminals 58 and 59 from terminal 26 extending through back panel openings 70 and 71, respectively. This is best seen in FIGS. 8 and 9, where two terminals 26 and 26' are mounted within housing 22.

The openings 25 and 25' on top 21 of housing 22 and openings 38 and 38' in cantilevered panels 37 and 37' are aligned with openings 62 and 62' of terminals 26 and 26', respectively. As seen best in FIG. 3, housing 22 has space 27 and 27' for two terminals 26 and 26', separated by wall 33. Of course, it would be obvious to make housing 22 larger or smaller to enclose more or less terminals 26 if desired. Further, additional corresponding openings 25, 38 and 62 may be added to accommodate multiple interconnection.

Figure 10A:
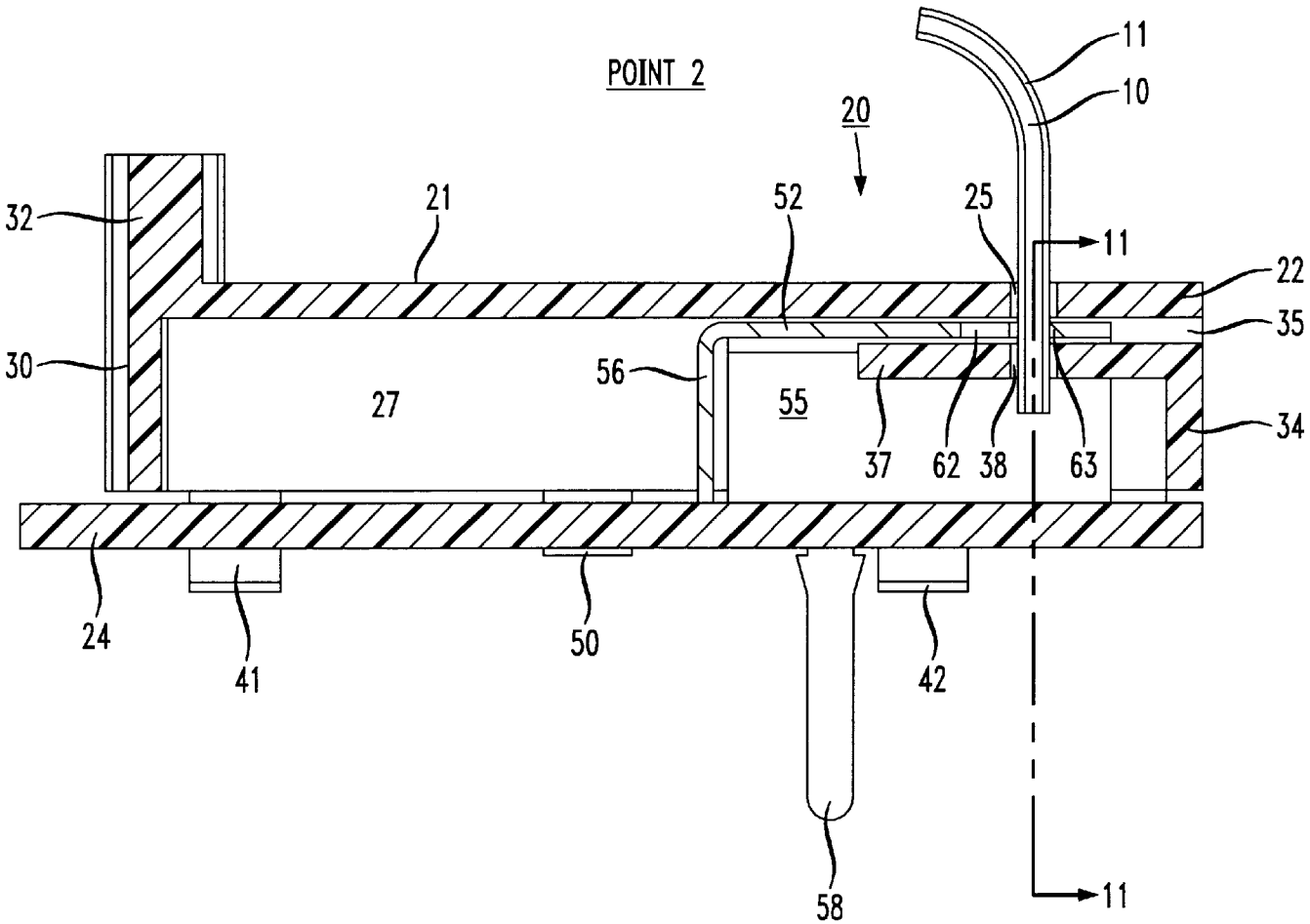
FIG. 10A is a cross-sectional view taken along line 10—10 of FIGS. 8 or 9, but illustrating the conductor in electrical contact with the terminal (point 2).
Figure 12:
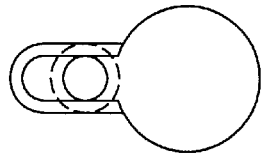
FIG. 12 is a cross-sectional view taken along line 12—12 of FIG. 11, showing the conductor's insulation cut and in electrical contact with the terminal.
Figure 11:
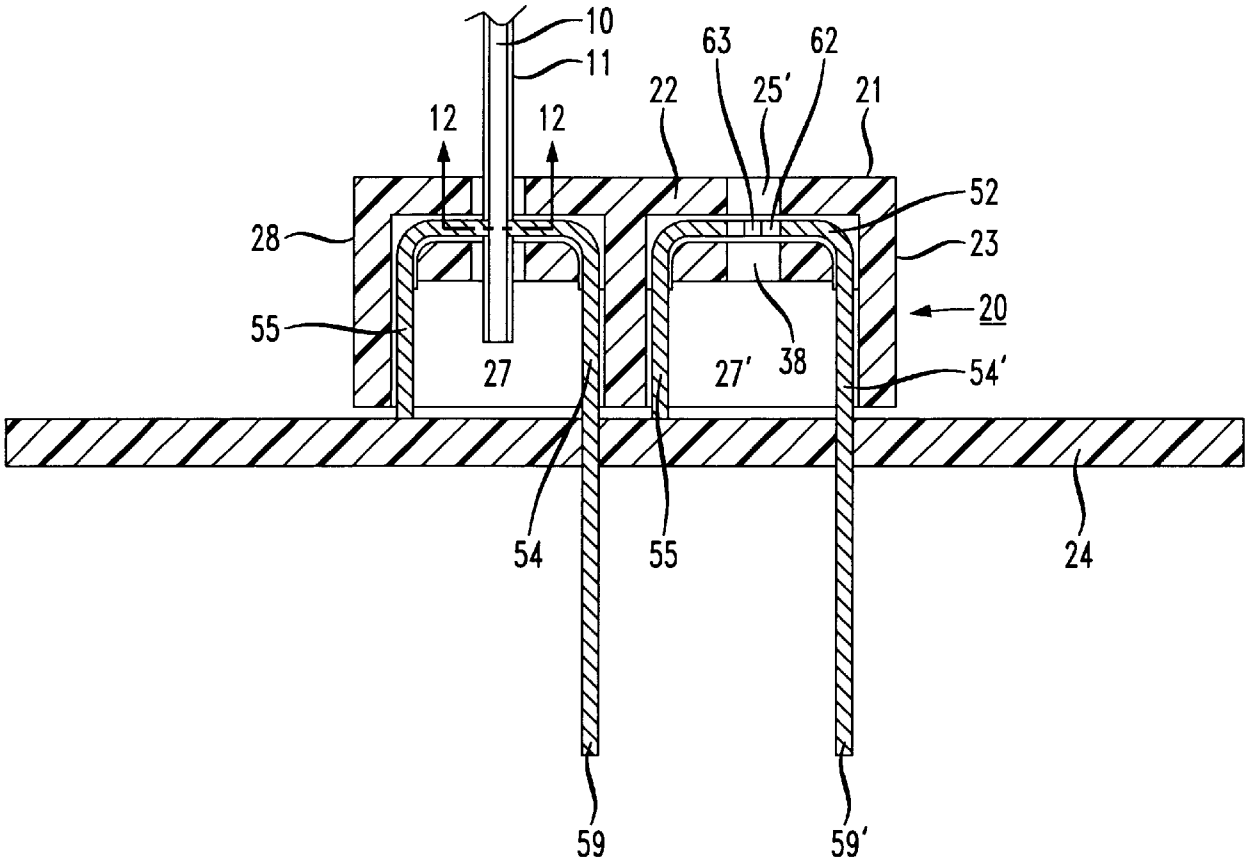
FIG. 11 is a cross-sectional view taken along line 11—11 of FIG. 10A.

Once the housing 22 and terminal 26 are mounted on back panel 24, conductors or wires can be connected or wire wrapped to tails 58 and 59. As shown in FIG. 10, a conductor 10 having insulation 11 can be electrically connected to a terminal 26 by placing it in opening 25 through opening 62 of terminal 26 and through opening 38 in the cantilevered panel of housing 22. To make the electrical connection, the user takes handle 32 and, as shown in FIG. 10, moves housing 22 towards the conductor 10 until the limits of the length of various openings 64 and 66 stop the forward movement of their corresponding latching legs 39, 40, 44 and 45. At the same time, fingers 48 with the tapered extension 50 moves from one notch 69 (point 1) to snap into the other notch 69 (point 2) to alert the user that the maximum distance has been reached and to positively engage the housing 22 at this position. The operation of moving the housing 22 from points 1 to 2 pushes conductor 10 from the larger opening 62 of terminal 26 into the narrow keyhole-type opening 63 such that the conductor 10 is forced against the sharp edges of the narrower portion of opening 63 in terminal 26 to cut through the insulation 11 and make good contact with the conductive metal of conductor 10 (as shown in FIGS. 10A and 11). The two openings 25 and 38 of the top 21 and panel 37 of housing 22, respectively, support the conductor 10 on both sides of terminal 26 and maintaining the conductor 10 in position while the insulation is being displaced. Since terminal 26 is similarly made of conductive material, an electrical connection is made, then, between conductor 10 and the tails 58 and 59 for connection to another conductor (not shown).

In a similar manner, other conductors 10 can be inserted in the adjacent opening 25' for making contact with terminal 26', tails 58' and 59' for connection to another set of conductors.

Thus, it is shown that by easy access through top-faced openings, a conductor is quickly and easily positioned in the terminal for electrical connection by a quick sliding movement of the housing.

Although certain features of the invention have been illustrated and described herein, other better modifications and changes will occur to those skilled in the art. It is therefore to be understood that the appended claims are intended to cover all such modification and changes that fall within the spirit of the invention.

What I claim is:

1. A top access insulation displacement connector for receiving and retaining a first conductor for electrical connection with a second conductor, comprising:

a housing having a top with outer and inner surfaces, at least one wall extending from the top and defining an interior space, a panel extending into said space at a predetermined distance from the inner surface of said top, said panel being movable in association with said housing, said housing top having at least one opening therein, said panel having at least one corresponding opening therein axially aligned with said top opening, a conductive terminal member having a base, said base having at least one corresponding tapered opening therein with the narrower part of said opening facing an end, said terminal member dimensioned to fit within said interior space of said housing and with said base disposed between said panel and said inner surface of said housing top, the larger part of each of said corresponding tapered opening, said corresponding housing top opening and said corresponding panel opening all being in axial alignment and dimensioned to receive the first conductor therein, and at least one terminal tail for connecting to the second conductor, a base plate having top and bottom surfaces with at least one opening for receiving said terminal tail, said housing slideable mounted on said top surface of said base plate and adapted to be slid a longitudinal distance from point 1 to point 2 and back, point 1 being where said top, panel and the larger part of said tapered openings are axially aligned and point 2 being where said top and panel openings are axially aligned with the narrower part of the tapered opening, said terminal tail extending from said base plate bottom surface;

whereby placing the first connector into said corresponding top opening through tapered opening and into said panel opening when said housing is at point 1 and sliding said housing toward point 2 such that the first conductor is forced into said narrower part of said tapered opening for cutting through the insulation and making an electrical contact with the terminal member.

2. The connector in accordance with claim 1, wherein said housing is generally channel-shaped.

3. The connector in accordance with claim 1, wherein said panel extends from a housing wall.

4. The connector in accordance with claim 3, wherein said panel is cantilevered from said housing wall.

5. The connector in accordance with claim 1, wherein said housing has at least one latching member for cooperatively mounting said housing onto said base plate through said latch openings to hold said housing in a slideable position.

6. The connector in accordance with claim 5, wherein at least one of said latching members is a detent.

7. The connector in accordance with claim 1, wherein said housing has at least one latching member and said base plate has at least one cooperative opening for receiving said latching member.

8. The connector in accordance with claim 7, wherein said cooperative base plate opening is larger than the length of said latching member to allow a predetermined sliding movement of said housing along said base plate from point 1 to point 2 and back.

9. The connector in accordance with claim 8, wherein said housing has at least one detent member extending therefrom and said base plate has at least one corresponding opening for receiving said detent member with two notches spaced a predetermined distance apart, said predetermined distance equals the excess length of said openings on said base plate with respect to the latching members of said housing, each of said notches positively receiving said detent member as the housing moves from point 1 to point 2.

10. The connector in accordance with claim 1, wherein said terminal member is generally channel-shaped.

11. The connector in accordance with claim 5, wherein each of said latching members having a flat surface spaced from the underside of said housing wall a distance slightly larger than the thickness of said base plate so that said latching member holds said housing securely against said base plate.

12. A top access insulation displacement connector for receiving and retaining a first conductor for electrical connection to a second conductor, comprising:

a housing having a top and peripheral side walls and one end wall extending from the top and defining a space adjacent said one end wall, a cantilevered panel extending from said one end wall into said space generally parallel to and spaced a predetermined distance from the underside of said housing top, each of said top and said cantilevered panel of said housing having at least one axially aligned opening therein, and at least one latching member extending from one of said side walls;

a conductive terminal member having a generally channel-shape with a base and at least two side walls extending therefrom, said base having at least one corresponding tapered opening therein with the narrower part of said tapered opening facing an end, said terminal member dimensioned to fit within said space of said housing with said terminal base disposed between said cantilevered panel and the underside of said housing top, and at least one terminal tail extending from one side wall of said terminal member for connecting to a second conductor, a base plate having a plurality of openings therein aligned to cooperatively receive said latching members of said housing and to receive said terminal tail, said base plate openings for said latching members being slightly longer than the width of said latching members;

said terminal member being positioned within said housing so that each of said tapered openings is axially aligned with corresponding top and panel openings of said housing, all of said openings being larger than the outer diameter of the first conductor to be received therein, whereby the first conductor being passed through said top opening passes through said corresponding tapered opening and through said panel opening, said housing being slideable along said base plate in a direction generally parallel to said latching member openings of said base plate, whereby slideably moving said housing towards the first conductor in said aligned openings moves the first conductor towards the narrower part of the tapered opening to cut through the insulation of the conductor, thereby making an electrical connection between the first conductor inserted in said correspondingly aligned openings and said terminal member.

* * * * *